US005911308A

United States Patent [19]

Chafitz et al.

[11] Patent Number: 5,911,308

[45] Date of Patent: Jun. 15, 1999

[54] SPORTS SAFETY MASK

[76] Inventors: Steven R. Chafitz; Gerald W. Spessard, both of c/o Game Face, 16 E. Patrick St., Frederick, Md. 21701

[21] Appl. No.: 09/060,079

[22] Filed: Apr. 15, 1998

[51] Int. Cl.[6] ..... A41D 13/00; A42B 3/18

[52] U.S. Cl. ..... 2/9

[58] Field of Search ..... 2/9, 15, 424, 425, 2/10, 11

[56] References Cited

U.S. PATENT DOCUMENTS

| | | | |
|---|---|---|---|
| D. 237,843 | 12/1975 | Peterson et al. | D2/3 |
| 1,060,220 | 4/1913 | White | 2/9 |
| 1,449,183 | 3/1923 | Johnstone | 2/9 |
| 1,488,812 | 4/1924 | Goodman | 2/9 |
| 1,665,386 | 4/1928 | Walmer et al. | 2/9 |
| 2,020,249 | 11/1935 | Shibe | 2/9 |
| 2,028,462 | 1/1936 | Malcom | 2/9 |
| 2,065,410 | 12/1936 | Woloson | 2/9 |
| 2,100,553 | 11/1937 | Schutt | 2/9 |
| 2,502,377 | 3/1950 | Goldsmith | 2/9 |
| 2,627,602 | 2/1953 | Goldsmith | 2/9 |
| 3,373,443 | 3/1968 | Marietta | 2/424 |
| 3,608,089 | 9/1971 | Abbatelli | 2/9 |
| 3,729,745 | 5/1973 | Latina | 2/9 |
| 4,173,795 | 11/1979 | Lundin et al. | 2/425 |
| 4,367,561 | 1/1983 | Solari | 2/439 |
| 4,631,758 | 12/1986 | Newman et al. | 2/424 |
| 4,736,466 | 4/1988 | Kallstrom | 2/9 |
| 4,754,501 | 7/1988 | Yahn | 2/424 |
| 4,933,993 | 6/1990 | McClelland | 2/424 |
| 5,012,527 | 5/1991 | Michel | 2/9 |
| 5,107,543 | 4/1992 | Hansen | 2/9 |
| 5,148,550 | 9/1992 | Hodgkinson et al. | 2/424 |
| 5,206,955 | 5/1993 | Milligan | 2/9 |
| 5,267,353 | 12/1993 | Milligan | 2/9 |
| 5,335,371 | 8/1994 | Spessard | 2/9 |
| 5,384,914 | 1/1995 | Caveness et al. | 2/9 |
| 5,394,564 | 3/1995 | Rodriguez | 2/9 |
| 5,571,217 | 11/1996 | Del Bon et al. | 2/9 |
| 5,661,849 | 9/1997 | Hicks | 2/9 |

*Primary Examiner*—Michael A. Neas
*Attorney, Agent, or Firm*—Larson & Taylor

[57] ABSTRACT

A safety sports mask assembly includes an integral face mask comprising a brow bar disposed, over an upper face region of a wearer above the eyes; a nose guard disposed over a portion of the nose; and a bottom bar disposed over a portion of the chin area. Integral side walls join the brow bar, nose guard and bottom bar together in spaced relation so as define an eye opening and a mouth opening. A strengthening element extends around the eye opening and a further strengthening element extends around the mouth opening. The strengthening elements form a rearwardly facing channel in a region of the nose guard between the opening and mouth openings. The nose guard also includes a reinforcement element extending thereacross and projecting from the nose guard rearwardly into the channel such that the nose guard has an E-shaped cross section. Straps are affixed to the face mask for securing the mask to the head of a wearer.

17 Claims, 6 Drawing Sheets

SPORTS SAFETY MASK

FIELD OF THE INVENTION

The present invention relates to face masks used in various sports to prevent injury and, more particularly, to an improved safety mask for a baseball infielder, outfielder or other defensive player although the invention is clearly not limited to such an application.

BACKGROUND OF THE INVENTION

There are a relatively large number of patents relating to face guards, face masks, goggles and other protective devices designed to protect the face and head during various sports activities. Exemplary of these patents are: U.S. Pat. Nos. 1,449,183 (Johnstone); 2,020,249 (Shibe); 2,028,462 (Malcolm); 2,502,377 (Goldsmith et al.); 3,608,089 (Abbatelli); Des 237,843 (Peterson et al.); 4,173,795 (Lundin et al.); 4,367,561 (Solari); 4,631,758 (Newman et al.); 4,736,466 (Kallstrom); 4,754,501 (Yahn); 4,933,993 (McClelland); 5,012,527 (Michel); 5,107,543 (Hansen); 5,148,550 (Hodgkinson et al.); 5,267,353 (Milligan); 5,394,564 (Rodriquez); 5,571,217 (Del Bon et al.); and 5,661,849 (Hickes). A further patent of interest here is my U.S. Pat. No. 5,335,371 (Spessard) which relates to a baseball infielder's mask that includes a parallel bar structure across the mouth and nasal portions of the face and a bottom bar adapted to be positioned under the chin.

Although the patents referred to above are of general interest, the most relevant prior art insofar as the present invention is concerned appears to be a previous version of a sports safety mask which was developed by the inventor here and which is shown in FIGS. 1 to 3. This mask, which is generally denoted 10, is of a hard durable plastic construction including a upper brow portion or brow bar 12, a central nose guard or nose bar 14 and a chin portion or bottom bar 16 formed integrally with side portions or side walls 18.

An eye opening 20 is formed between brow bar 12 and nose guard 14. As shown in FIG. 3, nose guard 14 projects outwardly beyond brow bar 12 and bottom bar 16 and, as shown in FIGS. 1 to 3, is joined to bottom bar 16 by a pair of lateral spaced connecting elements or struts 22. Struts 22 extend upwardly and outwardly from bottom bar 16 in the vertical orientation of mask 10 illustrated in FIGS. 1 to 3 so as to divide the area between nose guard 14 and bottom bar 16, i.e., the area of the mouth of a wearer, into three openings 24, 26 and 28.

As can best be seen in FIG. 3, and can also be seen to some extent in FIG. 2, the nose guard 14 is of a generally C-shaped construction formed by upper and lower inwardly extending ridges or ribs 14*a* defining a channel 14*b*. As shown in FIG. 3, shallow channels 22*a* are formed in connecting struts 22.

As shown in FIG. 2, a series of protective pads or cushions, viz., a brow pad 30*a*, a chin pad 30*b*, a pair of upper side pads 30*c* and 30*d*, and a pair of lower side pads 30*e* and 30*f*, are affixed by an adhesive to the inside of mask 10 to provide cushioning of the mask 10 on the face of a wearer. As illustrated, these fixed pads are generally rectangular in shape and are flexible so as to conform to the shape of the part of the mask to which the pads are affixed. Thus, brow pad 30*a* and chin pad 30*b* are curved to match the curvature of brow bar 12 and bottom bar 16 while the side pads 30*c*, 30*d* and 30*e*, 30*f* lie substantially flat against the respective inside surfaces of the side portions 18 of the mask 10.

A pair of raised shield or visor support elements 32*a* and 32*b* of a shallow U-shape are provided on respective side portions 18 on opposite sides of eye opening 20. Elements 32*a* and 32*b* are used to support opposite ends of an optional clear plastic shield (not shown) which fits over eye opening 20.

Slots 34*a* and 34*b* are respectively provided in an upper area of the respective side portions 18. Slots 34*a* and 34*b* are used to connect a securing strap (not shown) to the mask 10 with one end of the strap being captured in one of the slots, e.g., slot 34*b*, and the other end of the strap being looped through the other slot, e.g., slot 34*a*, and affixed to itself by hooks and loops fasteners, as described in more below in connection with a single one of the fastening straps of the present invention.

Although the mask of FIGS. 1 to 3 has a number of advantages, the mask also suffers important disadvantages disclosed below particularly as a compared with the mask of the present invention.

SUMMARY OF THE INVENTION

In accordance with the invention, a sports safety mask is provided which affords a number of important advantages. For example, the mask provides full facial protection and full visibility and is also comfortable to wear. The mask particularly promotes confidence in young players, and, in this regard, protects players wearing dental braces or glasses and also offers protection for players with previous facial injury.

In addition to these general advantages, the mask of the invention provides important specific advantages over the safety sports mask of FIGS. 1 to 3. It will be appreciated that in order to be accepted by players, a sports safety mask must be both effective, i.e., strong and durable enough to serve its basic protective function over long period of hard usage, while also being light in weight. In the latter regard, a heavy mask which inhibits the head movements of a wearer or is otherwise cumbersome or uncomfortable to wear will simply not be accepted and thus, even if purchased, will not be regularly worn.

The mask of the present invention is extremely strong and durable and is essentially impossible to break under any normal conditions likely to be encountered (e.g., one can stand on the side of the mask and it will not break or permanently deform). This light weight and great strength is a product of a mask construction which includes relatively thin walls strengthened by an arrangement of strengthening ribs or beads around the peripheral edges of openings of the mask and an E-section nose guard having a "honeycomb" reinforcement construction or nose ring of the mask.

A further important feature of the mask of the invention is that a single mask can be adapted to fit children of any age as well as most adults. To accomplish this, a system of pads is provided as described below, including a detachable chin pad the vertical position of which can be adjusted to accommodate different face sizes and a brow pad arrangement wherein detachable brow comfort pads of different thicknesses cooperate with a permanent impact pad to accommodate different brow shapes and sizes. To enable the mask to fit different head sizes, the overall size of the mask of the invention is made larger than the mask of FIGS. 1 to 3, but, because of the various features discussed above, the weight is only slightly increased and the strength and durability is improved. For example, in an exemplary embodiment, the mask of the invention is made 20% larger than the mask of FIGS. 1 to 3 but weights only 0.6 oz. more (4.2 oz. versus 3.6 oz.).

The mask of the present invention also includes an improved holding strap arrangement, include a pair of cooperating straps, which provides firm holding of the mask in place as well as ready adjustment.

In accordance with a first aspect of the invention, a safety sports mask assembly is provided which comprises: an integral face mask comprising a brow bar adapted to be disposed, in use of the mask assembly, over an upper face region of a wearer above the eyes; a nose guard adapted to be disposed, in use of the mask assembly, over a portion of the nose of a wearer; a bottom bar adapted to be disposed, in use of the mask assembly, over a portion of the chin area of a wearer; and integral side walls for joining together said brow bar, said nose guard and said bottom bar in spaced relation so as define an eye opening between the brow bar and the nose guard and a mouth opening between the nose guard and the bottom bar, the face mask further comprising a strengthening element extending at least partially around the eye opening and a strengthening element extending at least partially around the mouth opening, the strengthening elements forming a rearwardly facing channel in a region of the nose guard between the eye opening and the mouth opening, and the nose guard further including a reinforcement element extending thereacross and projecting from the nose guard rearwardly into the channel such that the nose guard has an E-shaped cross section in said region of the nose guard; and strap means affixed to said face mask for, in use of the mask assembly, securing the face mask to the head of a wearer.

The mask preferably further includes at least two laterally spaced strengthening struts interconnecting the nose guard and the bottom bar so as divide the mouth opening into a central mouth area opening and first and second lateral mouth area openings and a strengthening element extending at least partially around each of the mouth openings.

Preferably, the strengthening elements extend completely around said eye opening and said mouth area openings.

Advantageously, the brow bar, bottom bar and side walls define an outer peripheral edge adapted to fit over the face of a wearer and the face mask further includes a further strengthening element extending at least partially around said peripheral edge. This further strengthening element preferably extends completely around said peripheral edge.

Preferably, the face mask further comprises a plurality of reinforcing members extending between the reinforcement element and the strengthening elements. Advantageously, two pairs of the reinforcement members are disposed between the eye opening and each of the mouth area openings. The reinforcement element defines a plane and, in a beneficial implementation, the reinforcement members are inclined at an angle with respect to said plane.

In an advantageous embodiment, a permanent impact pad is affixed to an inside surface of the brow bar and a detachable brow comfort pad is detachably secured to the impact pad. Preferably, the mask assembly further comprises a chin pad support element affixed to the bottom bar, and a detachable chin pad including a securing element for detachably securing the chin pad to the support element, the support element and the securing element being sized relative to one another in a direction transverse to the bottom bar so as to permit adjustment of the chin pad with respect to the face mask in said direction so as to accommodate wearers having faces of different lengths.

Preferably, the said strap means comprises first and second straps, the first strap being connected at one end thereof to one of said side walls and extending, in use of the mask assembly, between the side walls, and the second strap being secured at one end thereof to the brow bar and being looped, in use of the mask assembly, around the first strap.

In accordance with a further aspect of the invention, a safety sports mask assembly is provided which comprises: a plastic face mask comprising a brow bar adapted to be disposed, in use of the mask assembly, over an upper face region of a wearer above the eyes; a nose guard adapted be disposed, in use of the mask assembly, over a portion of the nose of wearer; a bottom bar adapted to be disposed, in the use of the mask assembly, over a portion of the chin area of a wearer; integral side walls for joining together the brow bar, the nose guard and the bottom bar in spaced relation so as define an eye opening between the brow bar and the nose guard and a mouth opening between the nose guard and the bottom bar; a brow pad support element affixed to an inside surface of the brow bar and extending at least partially across the brow bar; at least one removable brow pad adapted to be detachably secured to brow pad support element; a chin pad support element secured to an inside surface of the bottom bar; and a chin pad having a recessed portion for receiving the chin of a wearer, the chin pad including, affixed thereto, a securing element for detachably securing the chin pad to the chin pad support element, the chin pad support element and the securing element of the chin pad being sized relative to one another in a direction transverse to the bottom bar so as to enable adjustment of the chin pad with respect to the face mask in said direction to accommodate different face lengths.

The mask advantageously includes at least two laterally spaced struts interconnecting the nose guard and the bottom bar so as to divide said mouth opening into a central mouth area opening and first and second lateral mouth area openings and the mouth area openings are preferably defined by strengthening elements which extend therearound.

Preferably, the brow pad support element includes a plurality of laterally spaced hooks and loops fasteners and the at least one brow pad includes a like plurality of laterally spaced hooks and loops fasteners for individually engaging respective ones of the hooks and loops fasteners of the brow pad support element. Advantageously, the at least one brow pad comprises a plurality of brow pads of different thicknesses. Preferably, the mask assembly further comprises first and second side pad support elements affixed to respective ones of said walls, and first and second detachable side pads detachably secured to respective ones of the first and second side pad support elements. The side pads and side pad support elements preferably comprise hooks and loops fasteners and the side pads advantageously are substantially comma-shaped.

According to another aspect of the invention, a safety sports mask assembly is provided which comprises: an integral face mask comprising a brow bar adapted to be disposed, in use of the mask assembly, over an upper face region of a wearer above the eyes; a nose guard adapted to be disposed, in use of the mask assembly, over a portion of the nose of a wearer; a bottom bar adapted to be disposed, in use of the mask assembly, over a portion of the chin area of a wearer; and integral side walls for joining together the brow bar, the nose guard and the bottom bar in spaced relation so as define an eye opening between the brow bar and nose guard and a mouth opening between the nose guard and bottom bar; and strap means affixed to the face mask for securing said face mask to the head of a wearer, the strap means comprising first and second straps, the first strap being connected at one end thereof to one of said side walls and extending, in use of the mask assembly, between the side walls, and the second strap being connected at one end thereof to the brow bar and being looped, in use of the mask assembly, around the first strap.

Preferably, the first and second straps each comprise first and second spaced hooks and loops fasteners along the length thereof for permitting one portion of the straps to be connected to another portion thereof. Advantageously, the first and second straps are substantially identical and each includes anchoring means at the one end thereof for anchoring that one end in a corresponding slot in the face mask.

Other features and advantages of the invention will be set forth in, or apparent from, the following detailed description of preferred embodiments of the invention.

Brief Description of the Drawings

As described above.

DESCRIPTION OF THE PREFERRED EMBODIMENTS

Figure 4:
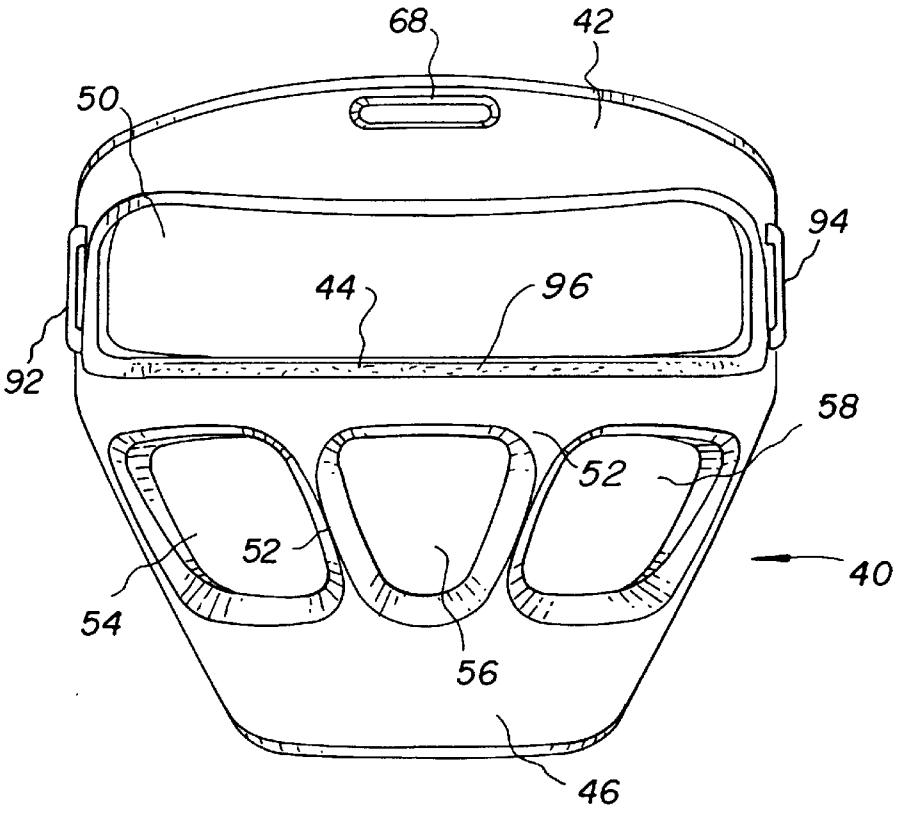
FIG. 4 is a front elevational view of a sports safety mask constructed in accordance with a preferred embodiment of the invention.
Figure 6:
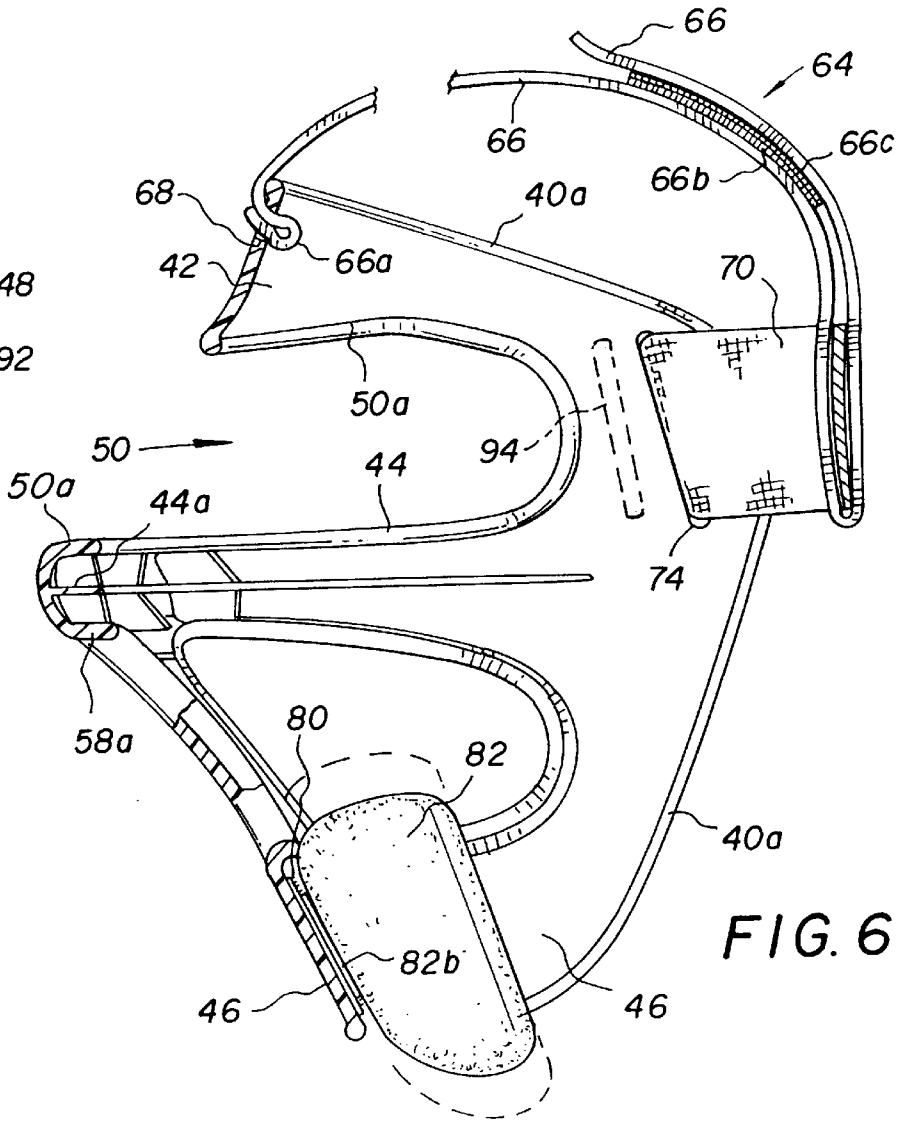
FIG. 6 is a transverse cross sectional view of the embodiment of FIG. 4, and including a strap arrangement not shown in FIGS. 4 and 5.
Figure 5:
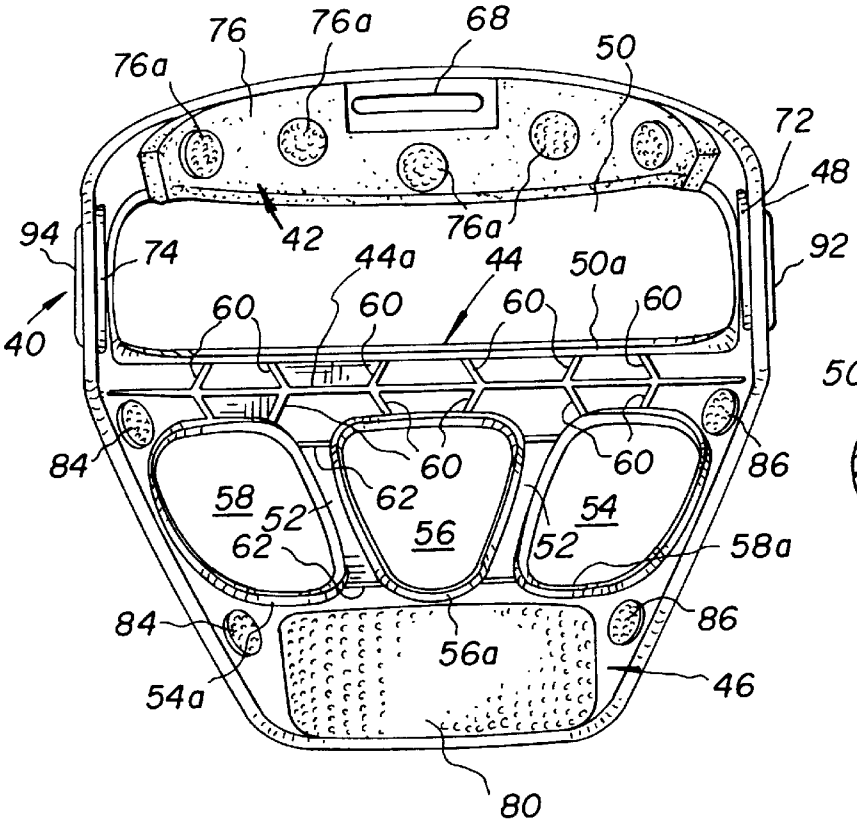
FIG. 5 is a rear elevational view of the embodiment of FIG. 4.

Referring to FIGS. 4 to 15 and referring first to FIGS. 4 to 6 in particular, a preferred embodiment of the safety sports mask of the invention is shown. The mask, which is generally denoted 40, is of a durable plastic construction including an upper brow portion or brow bar 42, a central nose guard or nose bar 44 and a chin portion or bottom bar 46, formed integrally with side portions or side walls 48.

An eye opening 50 is formed between brow bar 42 and nose guard 44. As shown in FIG. 6, nose guard 44 outwardly beyond brow bar 42 and bottom bar 46 and, as illustrated in FIGS. 4 to 6, is joined to bottom bar 46 by a pair of laterally spaced connecting elements or struts 52 which extend outwardly and upwardly from bottom bar 46 in the vertical orientation of mask 10 illustrated in FIGS. 4 to 6 so as to divide the area between nose guard 44 and bottom bar 46, i.e., the area of mouth of wearer, into three openings 54, 56 and 58.

Figure 2:
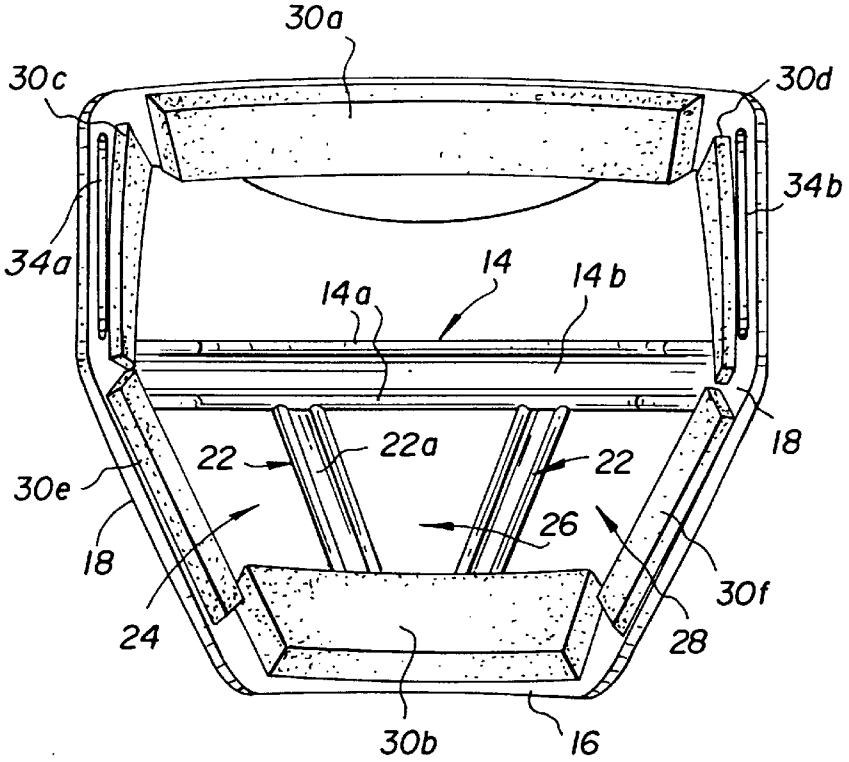
FIG. 2 PRIOR ART
FIG. 2 is a rear elevational view and FIG. 3 is a transverse cross sectional view, of a sports safety mask previously developed by one of the inventors here.
Figure 1:
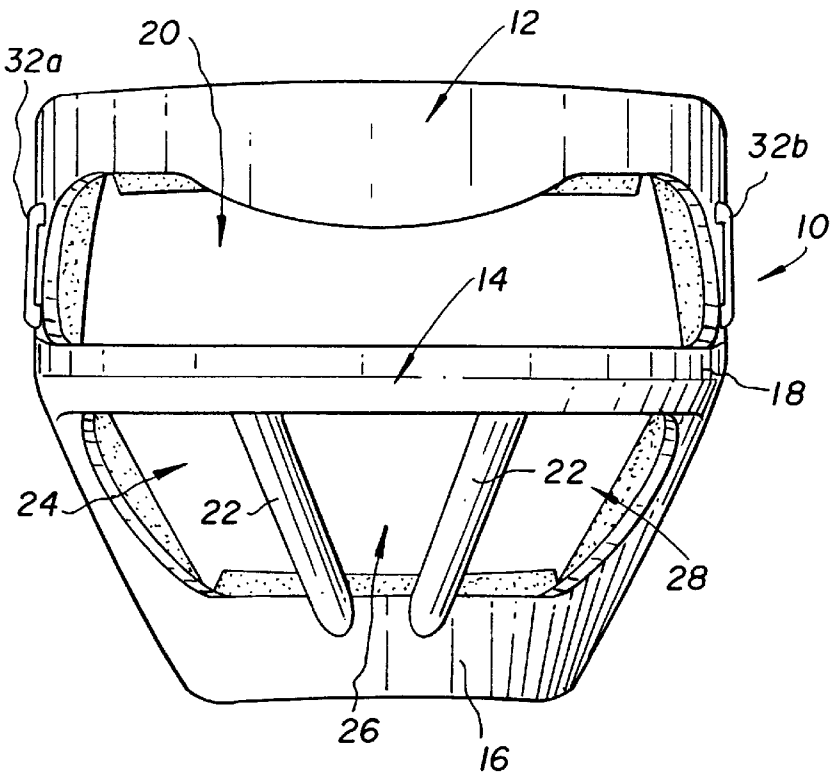
FIG. 1 PRIOR ART
FIG. 1 is a front elevational view.
Figure 3:
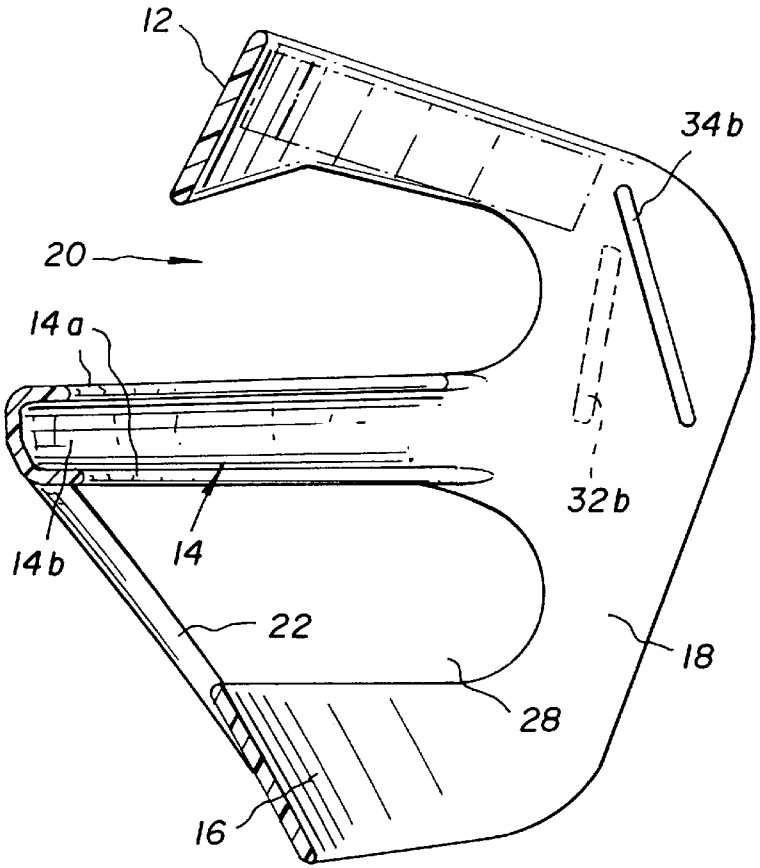
FIG. 3 PRIOR ART

It will be appreciated that the mask 40, as described so far, is similar to mask 40 of FIGS. 1 to 3 in the general overall configuration thereof. However, as discussed above, there are a number of important features of mask 40 which distinguish it from mask 40 of FIGS. 1 to 3, as well as other prior art, including features which make the mask both stronger and lighter in weight and features which improve the versatility, safety performance and wearability of the mask.

As best seen in FIGS. 5 and 6, nose guard includes a central reinforcement rib 44*a* and, as shown in FIG. 5, each of the openings 54, 56 and 58 includes a respective strengthening or reinforcement rib or bead 54*a*, 56*a* and 58*a* around the edge thereof. Similarly, eye opening 50 includes a strengthening or reinforcement rib or bead 50*a* around the edge thereof. As a consequence of these features, in the portions thereof between the eye opening 50 and the lower openings 54, 56 and 58, nose guard 44 is generally E-shaped in cross section. This is shown in FIG. 6, wherein, for the cross section illustrated, the upper rib or bead 50*a*, the central rib 44*a* and lower rib or bead 58*a* form the "E" shape and define upper and lower channels.

As shown in FIG. 5, plural pairs of inclined strengthening members or brace plates 60 are provided in the upper and lower channels defined by the "E" shape of nose guard 44, and are disposed so as to form what can be regarded as a honeycomb-like pattern of strengthening elements. More particularly, considering the area between eye opening 50 and lower opening 58 as exemplary, upper and lower pairs of brace plates 60, i.e., pairs formed by an upper plate between rib 50*a* and central rib 44*a* and a lower plate between central rib 44*a* and rib 58*a*, define a pair of facing "chevrons," as illustrated. The use of brace plates or strengthening members in general provides additional strengthening of the nose guard area of mask 40 and the inclined plates 60 illustrated resist certain bending or torsional forces better than vertical plates. In addition, pairs of vertically spaced, horizontally extending strengthening elements or brace plates 62 are provided between adjacent sides of ribs 54*a* and 56*a* and between adjacent sides of ribs 56*a* and 58*a*.

It is noted that rib or ridge 50*a* is not of uniform depth or extent throughout the circumference of eye opening 50 and is of the greatest depth or extent in the portion thereof which forms an upper part of nose guard 44. This non-uniform extent is also characteristic of ribs 54*a*, 56*a* and 58*a* although the difference is less pronounced.

As shown in FIG. 6, a bead or ridge 40*a* extends completely around the peripheral edge of mask 40 to provide further strengthening. This feature, as well as the others discussed above, result in a very strong mask that is still quite light in weight. The mask 40 is preferably made of a polycarbonate, which is a particularly suitable material for meeting the strength, flexibility and weight requirements of the invention.

Figure 15:
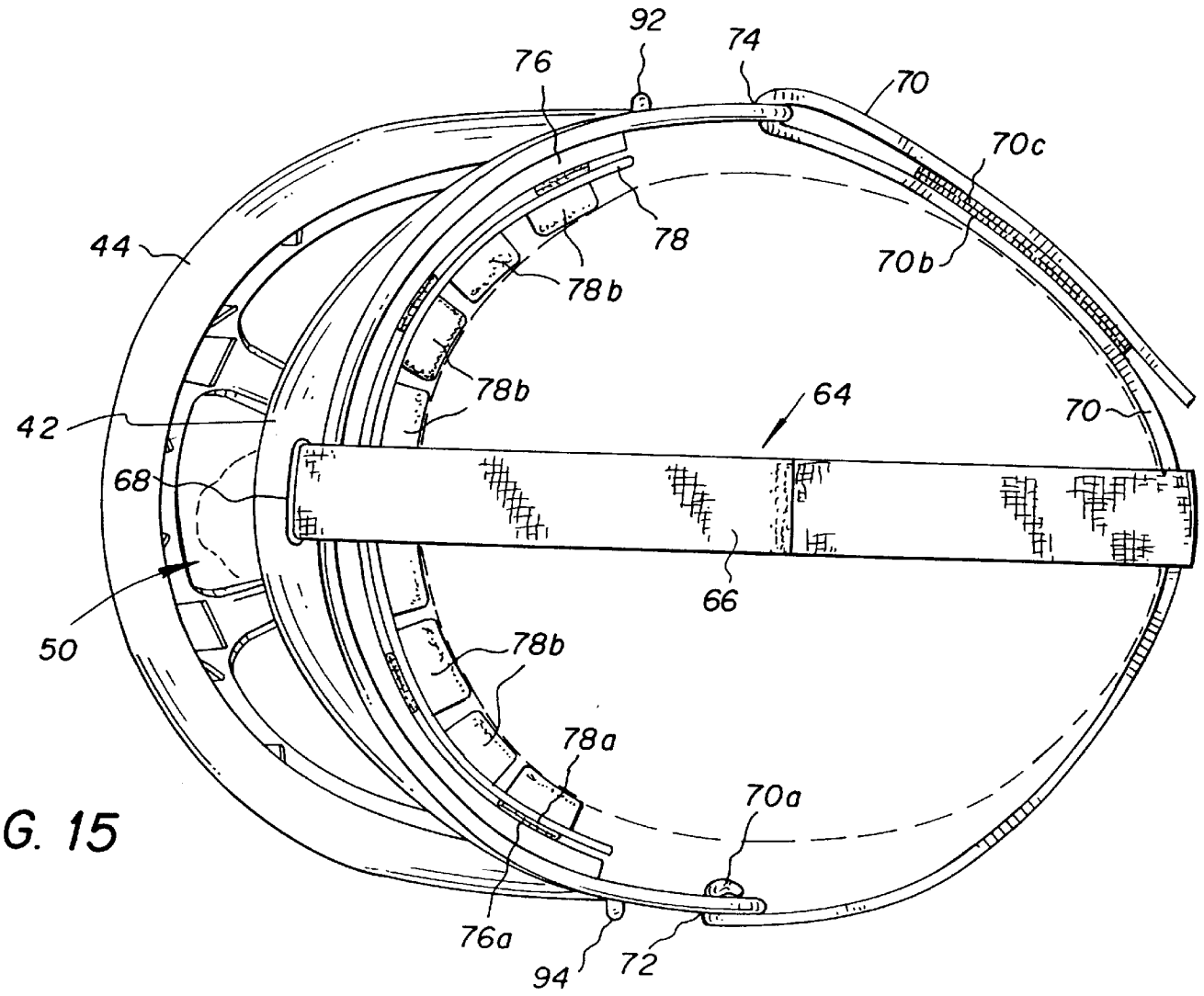
FIG. 15 is top plan view of the mask assembly of FIG. 4 to 6, including the strap arrangement of FIG. 6 and showing the mask assembly in place on the head of a wearer.

The mask 40 further includes a dual strap arrangement, generally denoted 64 for holding the mask in place. A first strap 66 is anchored at one end in a horizontal slot 68 in the brow bar 42 (see also FIGS. 4 and 5) by a thickened end portion 66*a* (formed, e.g., as shown in FIG. 6, by doubling over the end portion and stitching the doubled-over part to the adjacent portion) and includes spaced hooks and loops fasteners 66*b* and 66*c* along the length thereof as shown in FIG. 6. It will, of course, be understood that while general reference is made herein to hooks and hooks fasteners, one fastener will be a hooks fastener and the other will be a loops fastener adapted to be detachably connected or joined to the hooks fastener. A second strap 70 is similarly anchored at one end by a thickened portion 70*a* (see FIG. 15) in, e.g., slot 72 in the side wall 48 (there being a corresponding slot 74 in the opposite side wall 48) and similarly includes a pair of longitudinally spaced hooks and loops fasteners 70*b* and 70*c* corresponding to hooks and loops fasteners 66*b* and 66*c*. As shown in FIG. 15, the free end of strap 70 is looped through the opposite slot 74 and the hooks and loops fasteners 70*b* and 70*c* are then used to connect the free end to an intermediate portion of the strap 70. The free end of strap 66 is looped around strap 70 and the hooks and loops fasteners 66*b* and 66*c* are used to connect the free end to an intermediate portion, as shown in FIG. 6, in the same way as strap 70.

In contrast to the fixed pads of the mask of FIGS. 1 to 3, the mask of the invention uses detachable pads or cushions. Although detachable pads have been used in safety helmets for cyclists, the pad arrangement and manner of use thereof in the invention provides a number of important advantages as will become apparent. In general, the pad arrangement of the invention significantly increases the versatility of the mask by enabling the mask to be worn by users with substantially different face sizes (and thus by youths to adults).

Referring to FIG. 5, the mask includes a permanent impact pad 76 affixed to brow bar 42. Pad 76 includes a detachable affixing means in the form of a plurality of spaced hooks and loops fasteners 76*a* disposed across the length thereof. The affixing means is used to attach a detachable brow comfort pad 78 (see FIGS. 7 to 10) to permanent impact pad 76.

Figure 7:
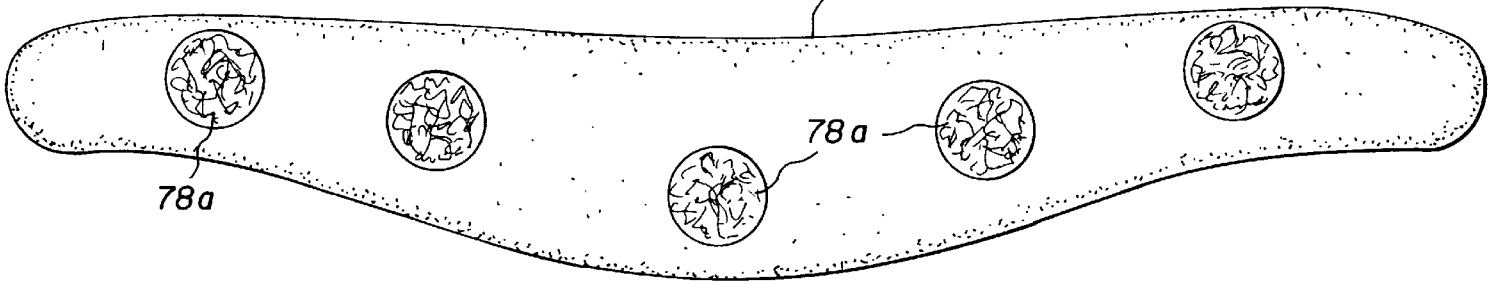
FIG. 7 is a rear elevational view, drawn to an enlarged scale, of a brow pad in accordance with a preferred embodiment of the invention.
Figure 8:
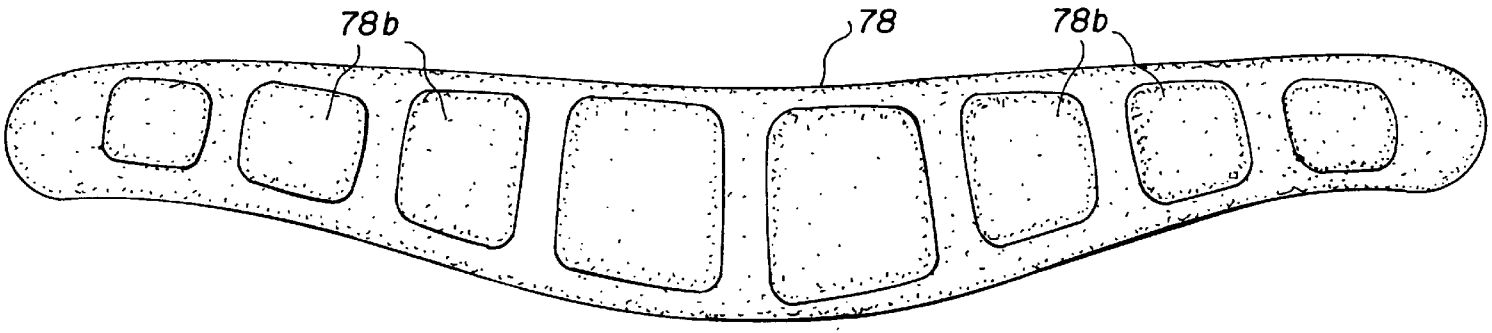
FIG. 8 is a front elevational view of the brow pad of FIG. 7.
Figure 9:
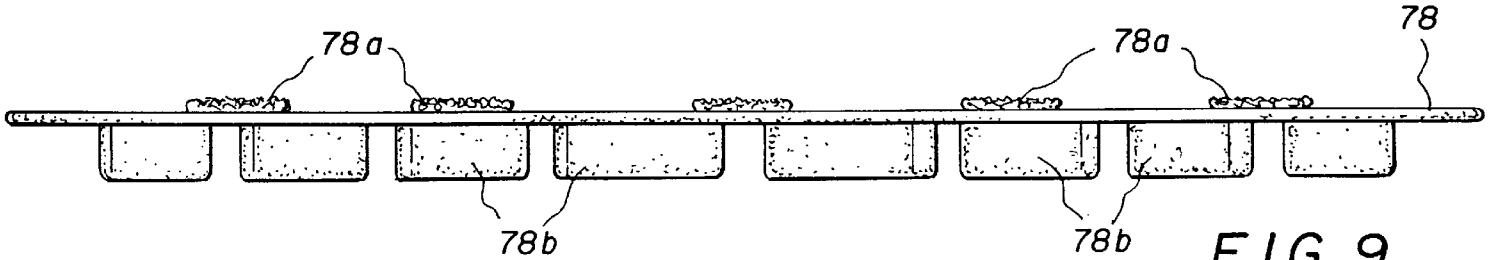
FIGS. 9 and 10 are top plan views of the brow pad of FIG. 7, respectively showing two pads of different thicknesses.
Figure 10:
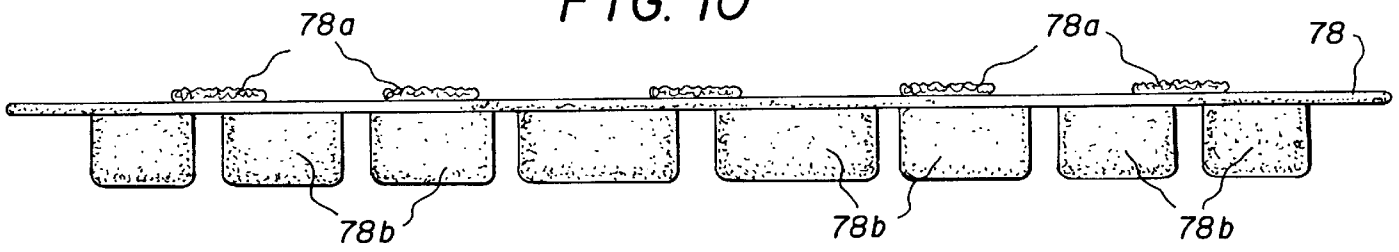

As shown in FIGS. 7 and 8 which are drawn to an enlarged scale as compared with FIG. 5, brow comfort pad 78 has a shape similar to that of impact pad 76 and, in practice, is of the same size. As shown in FIG. 7, one side of pad 78 includes a detachable affixing means in the form of a plurality of hooks and loops fasteners 78*a* disposed across the length thereof. The other side of pad 78 includes a plurality of discrete pad elements 78*b* which are of a size that increases from the ends of pad 78 toward the middle thereof. As can be seen by comparing FIGS. 9 and 10, brow comfort pad 78 is made in two different thicknesses so as to accommodate different head sizes and two brow comfort pads 78 of different thicknesses (as shown in FIGS. 9 and 10) would be provided with each mask.

Turning again to FIG. 5, mask 40 also includes a hooks and loops fastener element 80 affixed to the inside surface of bottom bar 46. Fastener element 80 is used to affix a chin cup or chin pad 82, shown in FIGS. 11 and 12, to the mask 10. This is illustrated in FIG. 6 wherein the chin cup 82 shown in place on the bottom bar 46 of the mask 10.

Figure 11:
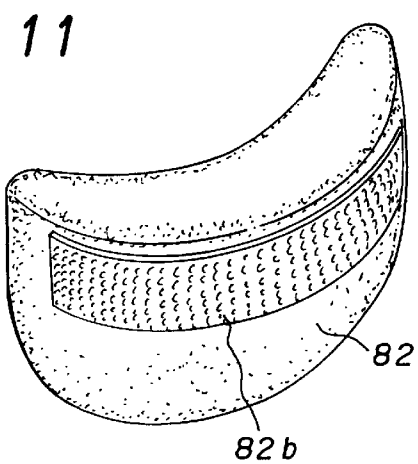
FIG. 11 is a front perspective view of a chin pad in accordance with a preferred embodiment of the invention.
Figure 12:
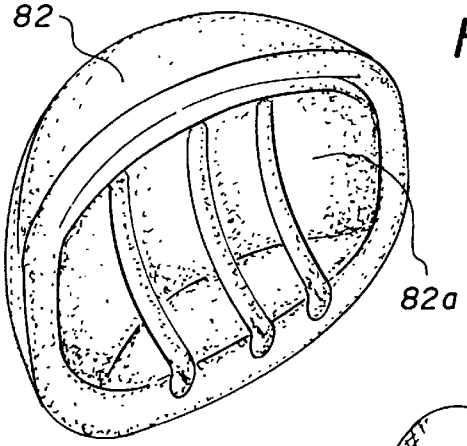
FIG. 12 is a rear perspective view of the chin pad of FIG. 11.
Figure 13:
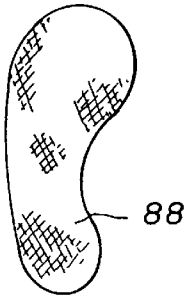
FIGS. 13 and 14 are plan views of respective side pads in accordance with a preferred embodiment of the invention.
Figure 14:
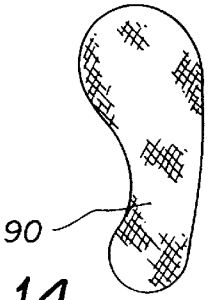

As shown in FIGS. 11 and 12, chin cups 82 is in the shape of a shallow "U" with the convex surface (see FIG. 12) being shaped to match or mate with the curved upper surface of bottom bar 46. The concave surface (see FIG. 11) of chin cup 82 include a specially shaped recess 82*a* for receiving the chin of a wearer of the mask. Further, the convex surface (FIG. 12) includes a hooks and loops fastener 82*b* disposed thereon which is adapted to be detachably affixed to chin pad fastener element 80 of the mask shown in FIG. 6. As indicated in dashed lines in FIG. 6, the position of chin cup 82 can be adjusted to accommodate the face of wearer, i.e., to provide the proper vertical fit, and thus enable the mask 40 to be worn by users having different face sizes or lengths.

Referring again to FIG. 5, the inside of mask 40 also includes two sets of spaced pairs of side pad hooks and loops fasteners 84 and 86 respectively attached to opposite inside surfaces of the side portions 48 of mask 40. The fastener elements 84 and 86 are adapted to detachably receive respective side pads 88 and 90 shown in FIGS. 13 and 14. The side pads 88 and 90 are, as shown, are generally in the shape of a "comma" and are attached to the respective pairs of fastener "dots" 84 and 86 at the upper and lower parts of the "comma."

Mask 40 also includes a pair of raised shield or visor support elements 92 and 94 found on respective side positions 48 on opposite sides of eye opening 50. Support elements 92 and 94 are used to support an optional plastic visor (not shown).

As can be seen in FIG. 4, the upper portion of nose guard or nose bar 44 has a roughened antireflective surface 96 in order to cut down on glare.

To prepare mask 40 for use, the chin cup 82 is affixed to the inside of bottom bar 46 by means of cooperating hooks and loops fasteners 80 and 82*b*. The chin cup 82 is affixed so that the straight top thereof aligns with the top of the bottom bar 46 and is centered laterally (left to right) below the middle mouth area opening 46.

The brow comfort pad 78 is affixed the permanent impact liner 76 and one or the other of the two thicknesses indicated in FIGS. 9 and 10 is used. In general, users aged nine and above should begin with the thinner pad (FIG. 9) while younger users should begin with the thicker pad (FIG. 10). The brow comfort pad 78 is affixed so that the straight edge is on top and the circular hooks and loops fasteners 76*a* and 78*a* are in alignment.

At this stage, the mask 40 is raised to the face of wearer and the wearer's chin is placed in chin cup 82. The mask is then tilted upwardly until the brow comfort pad 78 makes contact with the forehead. The brow comfort pad 78 should meet the face along the top of the eyebrows. If it does not, the vertical placement of chin cup 82 is adjusted, either upwardly or downwardly, to provide the proper vertical fit.

At this point, the brow comfort pad 78 should be checked to ascertain whether the pad 78 contacts the forehead along the full length of the pad as shown in FIG. 15. If the pad 78 that is chosen does not do this, and it may be helpful to have someone else view the fit from the top of the head, the other pad 78 should be used. The permanent impact liner 76 is never removed. The side pads 88 and 90 are attached to respective, ones of the hooks and loops fasteners 84 and 86 inside of the side walls or side bars 48 of mask 40. Although this is not specifically shown, pads 88 and 90 also come in different thicknesses and this assists in providing a custom fit. Of course, either pairs of thin pads, or pairs of thick pads, should be used at the same time.

Turning to the strap arrangement 64, the two straps 66 and 70 are identical and after one is selected as the horizontal strap (e.g., strap 70 as shown in the drawings), it is inserted from the inside into one of the slots 72 and 74 in the sides 48 of mask 40 (slot 72 is chosen in the drawings), with the corresponding hooks and loops fasteners facing away. The chosen strap 70 then passed, on the inside, through the slot 74 on the opposite side and the corresponding hooks and loops fasteners 70*b* and 70*c* are used to attached the strap 70 to itself.

The remaining strap (strap 66 in the drawings) is inserted through opening 68 in brow bar at the top of the mask 40 with the hooks and loops fasteners 66*b* and 66*c* facing up. The vertical strap 66 is looped under the horizontal strap 70 and the hooks and loops fasteners 66*b* and 66*c* are used to attach strap 66 to itself The straps 66 and 70 should be adjusted with nose guard 44 horizontal, and the adjustment is provided by tightening or loosening the loop formed by the vertical strap 66 while the horizontal strap 70 is horizontal and rests on the bottom of the loop. The horizontal strap 70 is then adjusted so that the mask 40 fits comfortably and snugly on the face. It is noted that the straps 66 and 70 are made of a flexible or stretchable material which assists in providing a snug fit.

Although the mask of FIGS. 4 to 15 includes a pair of struts 52 which serve a protective and strengthening function, it has been found that nose guard 44 is so strong that the struts 52 may be eliminated and that this may particularly advantageous where the mask 40 is designed for use in a game where the ball is relatively large with respect to the mouth opening between nose guard 44 and bottom bar 46.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A safety sports mask assembly comprising:

an integral face mask comprising a brow bar adapted to be disposed, in use of the mask assembly, over an upper face region of a wearer above the eyes; a nose guard adapted to be disposed, in use of the mask assembly, over a portion of the nose of a wearer; a bottom bar adapted to be disposed, in use of the mask assembly, over a portion of the chin area of a wearer; and integral side walls for joining together said brow bar, said nose guard and said bottom bar in spaced relation so as define an eye opening between said brow bar and said nose guard and a mouth opening between said nose guard and said bottom bar, said face mask further comprising a strengthening element extending at least partially around said eye opening and a strengthening element extending at least partially around said mouth opening, said strengthening elements forming a rearwardly facing channel in a region of the nose guard between said eye opening and said mouth opening, and said nose guard further including a reinforcement element extending thereacross and projecting from said nose guard rearwardly into said channel such that said nose guard has an E-shaped cross section in said region of said nose guard; and strap means affixed to said face mask for, in use of the mask assembly, securing said face mask to the head of a wearer.

2. A mask assembly as claimed in claim 1 wherein said strengthening members extend completely around said eye opening and said mouth opening.

3. A mask assembly as claimed in claim 1 wherein said brow bar, said bottom bar and said side walls define an outer peripheral edge adapted to fit over the face of a wearer and said face mask further includes a further strengthening element extending at least partially around said peripheral edge.

4. A mask assembly as claimed in claim 3 wherein said further strengthening element extends completely around said peripheral edge.

5. A mask assembly as claimed in claim 1 wherein said face mask further comprises a plurality of reinforcing members extending between said reinforcement element and said strengthening elements.

6. A mask assembly as claimed in claim 5 wherein two pairs of said reinforcement members are disposed between the eye opening and said mouth area opening.

7. A mask assembly as claimed in claim 6 wherein said reinforcement element defines a plane and said reinforcement members are inclined at an angle with respect to said plane.

8. A mask assembly as claimed in claim 1 further comprising a permanent impact pad affixed to an inside surface of said brow bar and a detachable brow comfort pad detachably secured to said impact pad.

9. A mask assembly as claimed in claim 1 further comprising a chin pad support element affixed to said bottom bar, and a detachable chin pad including a securing element for detachably securing said chin pad to said support element, said support element and said securing element being sized relative to one another in a direction transverse to said bottom bar so as to permit adjustment of said chin pad with respect to said face mask in said direction so as to accommodate wearers having faces of different lengths.

10. A mask assembly as claimed in claim 1 wherein said strap means comprises first and second straps, said first strap being connected at one end thereof to one of said side walls and extending, in use of the mask assembly, between said side walls, and said second strap being secured at one end thereof to said brow bar and being looped, in use of the mask assembly, around said first strap.

11. A safety sports mask assembly comprising:

a plastic face mask comprising a brow bar adapted to be disposed, in use of the mask assembly, over an upper face region of a wearer above the eyes; a nose guard adapted be disposed, in use of the mask assembly, over a portion of the nose of wearer; a bottom bar adapted to be disposed, in the use of the mask assembly, over a portion of the chin area of a wearer; and integral side walls for joining together said brow bar, said nose guard and said bottom bar in spaced relation so as define an eye opening between said brow bar and said nose guard and a mouth opening between said nose guard and said bottom bar;

an impact pad affixed to an inside surface of said brow bar and extending at least partially across said brow bar;

at least one removable brow pad adapted to be detachably secured to said impact pad;

a chin pad support element secured to an inside surface of said bottom bar; and a chin pad having a recessed portion for receiving the chin of a wearer, said chin pad including, affixed thereto, a securing element for detachably securing said chin pad to said chin pad support element, said chin pad support element and said securing element of said chin pad being sized relative to one another in a direction transverse to said bottom bar so as to enable adjustment of said chin pad with respect to said face mask in said direction to accommodate different face lengths.

12. A mask assembly as claimed in claim 11 wherein said impact pad includes a plurality of laterally spaced hook and loop fasteners and said brow pad includes a like plurality of laterally spaced hook and loop fasteners for individually engaging respective ones of the hook and loop fasteners of the brow pad.

13. A mask assembly as claimed in claim 12 wherein said at least one brow pad comprises a plurality of brow pads of different thicknesses.

14. A mask assembly as claimed in claim 11 further comprising at least first and second side pad support elements affixed to respective ones of said side walls, and first and second detachable side pads detachably secured to respective ones of said first and second side pad support elements.

15. A mask assembly as claimed in claim 14 wherein said side pads and said side pad support elements comprise hook and loop fasteners and wherein said side pads are substantially comma-shaped.

16. A mask assembly as claimed in claim 11 wherein said face mask further comprises at least two laterally spaced strengthening struts interconnecting said nose guard and said bottom bar so as to divide said mouth opening into a central mouth area opening and first and second lateral mouth area openings; said face mask further comprising a strengthening element extending at least partially around said eye opening and a strengthening element extending at least partially around said mouth area openings, said strengthening elements forming a rearwardly facing channel in regions of the nose guard between said eye opening and said mouth area openings, and said nose guard further including a reinforcement element extending thereacross and projecting from said nose guard rearwardly into said channel.

17. A safety sports mask assembly comprising:

an integral face mask comprising a brow bar adapted to be disposed, in use of the mask assembly, over upper face region of a wearer above the eyes; a nose guard adapted to be disposed, in use of the mask assembly, over a portion of the nose of a wearer; a bottom bar adapted to be disposed, in use of the mask assembly, over a portion of the chin area of a wearer, and integral side walls for joining together said brow bar, said nose guard and said bottom bar in spaced relation so as define an eye opening between said brow bar and said nose guard and a mouth opening between said nose guard and said bottom bar, said mask further including at least two laterally spaced strengthening struts interconnecting said nose guard and said bottom bar so as divide said mouth opening into a central mouth area opening and first and second lateral mouth area openings, said bar brow, said bottom bar and said side walls defining an outer peripheral edge adapted to fit over the face of a wearer and said face mask including a strengthening element extending at least partially around said peripheral edge, said mask further comprising a further strengthening element extending at least partially around said eye opening and a further strengthening element extending at least partially around each of said mouth area openings such that the further strengthening elements form a rearwardly facing channel in regions of the nose guard between said eye opening and said mouth area openings, said nose guard further including a reinforcement element extending thereacross and projecting from said nose guard rearwardly into said channel, and a plurality of reinforcing members extending between said reinforcement element and said further strengthening elements in said regions of said nose guard; and strap means affixed to said face mask for, in use of the mask assembly, securing said face mask to the head of a wearer.

* * * * *